PM018 XR 4,247,930

United States Patent [19]
Martin

[11] 4,247,930
[45] Jan. 27, 1981

[54] TIMEPIECE WITH HYBRID DISPLAY

[75] Inventor: Wolfram Martin, Darmstadt, Fed. Rep. of Germany

[73] Assignee: Gebrüder Junghans GmbH, Schramberg, Fed. Rep. of Germany

[21] Appl. No.: 38,336

[22] Filed: May 11, 1979

[30] Foreign Application Priority Data

May 18, 1978 [DE] Fed. Rep. of Germany ..... 2821619

[51] Int. Cl.³ ..... G04C 19/00; G04C 17/00
[52] U.S. Cl. ..... 368/84; 368/242
[58] Field of Search ..... 350/331, 334, 335; 58/50 R, 127 R; 368/242, 84

[56] References Cited

U.S. PATENT DOCUMENTS

| | | | |
|---|---|---|---|
| 3,863,436 | 2/1975 | Schwarzschild et al. | 58/50 R |
| 3,874,163 | 4/1975 | Ikeno | 58/50 R |
| 3,911,665 | 10/1975 | van Berkum | 58/50 R |

*Primary Examiner*—Gene Z. Rubinson
*Assistant Examiner*—John B. Conklin
*Attorney, Agent, or Firm*—Scully, Scott, Murphy & Presser

[57] ABSTRACT

An electronic timepiece, in particular, a battery-operated quartz wristwatch including a housing in which there is arranged an analog display mechanism as well as a liquid crystal display unit which facilitate a display of different time magnitudes. The display surface of the liquid crystal display is practically as large as the watch dial surface of the analog display mechanism. The liquid crystal display unit is arranged in the housing of the watch in front of so as to superimpose the analog display mechanism. Preferably, the liquid crystal display is transparent and constructed as a replacement for the usual watch crystal as the generally viewed protective cover for the watch housing.

4 Claims, 2 Drawing Figures

TIMEPIECE WITH HYBRID DISPLAY

BACKGROUND OF THE INVENTION

1. Field of the Invention

The present invention relates to an electronic timepiece, and in particular, a battery-operated quartz wristwatch including a housing in which there is arranged an analog display mechanism as well as a liquid crystal display unit which facilitate a display of different time magnitudes.

2. Discussion of the Prior Art

A timepiece of that type is already known from U.S. Pat. No. 3,911,665. In this timepiece, hours and minutes are indicated through the intermediary of indicator hands and a watch dial. Provided for the display of the seconds, day or the date is a liquid crystal display (LCD) or a display by means of light-emitting diodes (LED). The liquid crystal display is arranged in a cutout formed in the watch dial. The display surface thereof is small in comparison with the size of the watch dial.

A watch having a liquid crystal display whose appearance can be varied is described in U.S. Pat. No. 3,874,163. Through the rotation of one of the polarization filters of the liquid crystal display it is possible to render the numerals visible so as to be either dark on a bright background, or bright on a dark background. A hybrid display is not provided in this particular instance.

SUMMARY OF THE INVENTION

Accordingly, it is an object of the present invention to contemplate a timepiece of the above-mentioned type, in particular a small watch, in which the display surface of the liquid crystal display is practically as large as the watch dial surface of the analog display mechanism.

The above-mentioned object is achieved according to the invention in that the liquid crystal display unit is arranged in the housing of the watch in front of so as to superimpose the analog display mechanism. Preferably, the liquid crystal display is transparent and constructed as a replacement for the usual watch crystal as the generally viewed protective cover for the watch housing.

Achieved by means of the inventive timepiece is that the display surface of the liquid crystal display is practically just as large as the dial of the analog display mechanism. Representable thereby in a large scale is a multi-position display with the date, day, month and year and, upon occasion, also a waking alarm, timer, or a stop timer. Moreover, it is also possible to indicate the day of the week. It is not necessary to provide for an increase in the size of the timepiece for the purpose of a visual presentation of the data indicated by the liquid crystal display. This provides a particularly advantageous effect when applied to wristwatches.

In a preferred embodiment of the invention, one of the polarization filters of the liquid crystal display is rotatable about an angle of at least 45°. This renders it possible that the liquid crystal display be made invisible without the need for electrical switch means through rotation of the polarization filter. When the polarization filter is constructed so as to be rotatable through an angle of 90°, this will make it possible that the numerals of the liquid crystal display can be made to appear either darkly or transparent on the covering watch crystal.

BRIEF DESCRIPTION OF THE DRAWINGS

Further advantageous embodiments of the invention may be ascertained from the following detailed description thereof, taken in conjunction with the accompanying drawings; in which.

DETAILED DESCRIPTION

Figure 1:
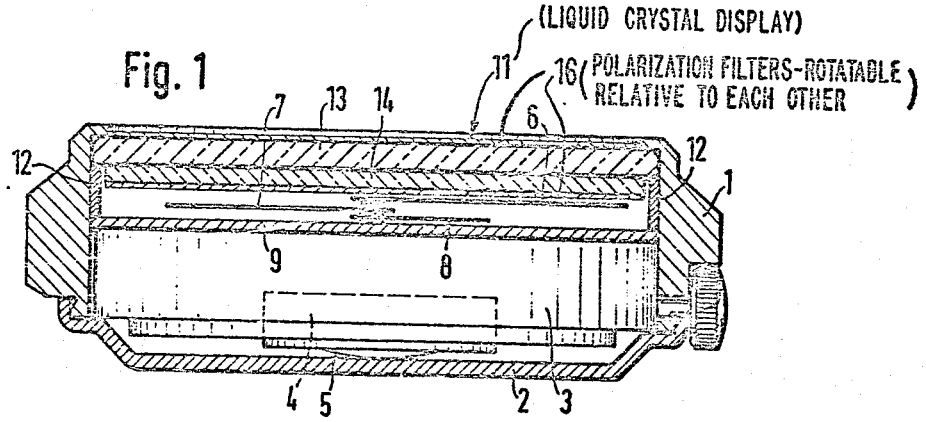
FIG. 1 illustrates a transverse sectional view through a wristwatch incorporating the inventive display arrangement.

Arranged in a watch housing 1 having a bottom cover 2 are an analog display mechanism 3 and a battery 4 which, through the intermediary of a contact spring 5, are supported on the bottom cover 2. The analog display mechanism 3 contains the known electronic switching circuits for time control, as well as the mechanical drive for a second hand 6, a minute hand 7, and an hour hand 8. Located between the analog display mechanism 3 and the indicator hands 6, 7 and 8 is a watch dial 9 which is provided with the indicia 10 recognizable in FIG. 2.

In lieu of the usual watch cover crystal, a liquid crystal display unit 11 is arranged in the housing 1. This unit entirely covers the watch dial 9. The electrodes of the liquid crystal display unit 11 are connected with an electronic circuit through the intermediary of contact strips 12, and which is arranged in the space behind the watch dial 9. The liquid crystal display unit 11 is equipped with an alphanumerical display which indicates the weekdays by means of two letters, and the day, month and year by means of numerals (refer to FIG. 2).

The electrodes and the liquid crystal of display unit 11 are arranged between two transparent plates 13 and 14. The exterior surfaces of the two plates are concurrently constructed as polarization filters.

Figure 2:
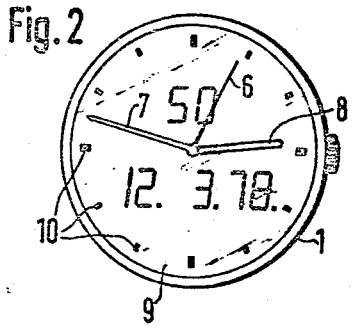
FIG. 2 is a plan view of the watch of FIG. 1 shown in a generally reduced scale.

In another embodiment of the invention, it is not the exterior surfaces of the two plates 13 and 14 which are constructed as polarization filters, but arranged on, respectively, each of both sides of the plates 13 and 14 is a separate, clear polarization filter 16. In this instance, one of the polarization filters 16 may be so positioned on the housing 1 as to be rotatable with respect to the other polarization filter. In accordance with the position of rotation of the two filters relative to each other, the display segments of the liquid crystal display unit 11 appear either dark at a transparent surrounding, or transparent at a dark surrounding. In one particular rotational position intermediate these two positions, the display segments are not visible. In all instances are the dial 9 and the indicator hands 6, 7 and 8 visible through the liquid crystal display unit 11. In FIG. 2 there is illustrated as to how the dial 9 together with the indicator hands 6, 7 and 8 are visible below the dark display of a weekday and date.

As may be ascertained from FIG. 2, the surface which is available for the alphanumerical display is practically as large as the watch dial. The individual display segments of the liquid crystal display unit 11 can hereby be so large as to produce an easily readable alphanumerical display.

Within the scope of the invention may be contemplated numerous other examplary embodiments. Thus, for example, it is possible that the seconds display may be incorporated in the liquid crystal display unit 11.

What is claimed is:

1. In an electronic timepiece, particularly a battery-operated quartz wristwatch, including a housing; an analog display mechanism and a liquid crystal display unit being arranged in said housing to facilitate the display of different time magnitudes; the improvement comprising: said liquid crystal display unit being arranged in said housing in front of and superimposed on said analog display mechanism and said liquid crystal display unit having a transparent construction and forming the housing cover on the viewed side of said timepiece.

2. Electronic timepiece as claimed in claim 1, said liquid crystal display unit comprising two transparent plates; and a liquid crystal layer intermediate said plates, the exterior surfaces of said two plates forming polarization filters.

3. Electronic timepiece as claimed in claim 1, polarization filters being located in front of and behind said liquid crystal display unit.

4. Electronic timepiece as claimed in claim 1, said analog display mechanism comprising a plurality of indicator hands for indicating time; and said liquid crystal display unit including a plurality of display elements for displaying dates such as weekday, date, month and year, and adapted to also display an alarm, a timer or stop time in a preferably digital mode.

* * * * *